US008646964B1

(12) United States Patent
Anderson et al.

(10) Patent No.: US 8,646,964 B1
(45) Date of Patent: Feb. 11, 2014

(54) METHOD AND APPARATUS FOR PRODUCING ASPHALT MIX PRODUCT COMPRISED OF RECYCLED ASPHALT PRODUCT AND VIRGIN MATERIAL

(75) Inventors: Russell W. Anderson, Goshen, NY (US); Lawrence C. Hanlon, Naugatuck, CT (US); Gordon F. Martin, Jupiter, FL (US)

(73) Assignee: Rap Process Machinery, L.L.C., Ramsey, NY (US)

( * ) Notice: Subject to any disclaimer, the term of this patent is extended or adjusted under 35 U.S.C. 154(b) by 1161 days.

(21) Appl. No.: 12/270,387

(22) Filed: Nov. 13, 2008

Related U.S. Application Data

(60) Provisional application No. 60/987,899, filed on Nov. 14, 2007.

(51) Int. Cl.
*B28C 5/46* (2006.01)

(52) U.S. Cl.
USPC ..... 366/7

(58) Field of Classification Search
USPC ..... 366/7
See application file for complete search history.

(56) References Cited

U.S. PATENT DOCUMENTS

| | | | | |
|---|---|---|---|---|
| 4,600,379 | A * | 7/1986 | Elliott | 432/13 |
| 5,188,299 | A | 2/1993 | Hendrickson et al. | |
| 5,294,062 | A | 3/1994 | Hendrickson et al. | |
| 5,520,342 | A | 5/1996 | Hendrickson et al. | |
| 7,758,235 | B1 * | 7/2010 | Collette | 366/7 |
| 2005/0175412 | A1 * | 8/2005 | Lloyd | 404/77 |
| 2007/0070801 | A1 * | 3/2007 | Musil et al. | 366/7 |

* cited by examiner

*Primary Examiner* — Yogendra Gupta
*Assistant Examiner* — Robert J Grun
(74) *Attorney, Agent, or Firm* — Arthur Jacob

(57) ABSTRACT

Asphalt mix product is produced for delivery at a desired temperature and is comprised of a mixture of recycled asphalt product and virgin material in a specified, selected proportion of recycled asphalt product to virgin material. Recycled asphalt product is heated in an indirectly heated recycled asphalt product heater to an elevated temperature. Virgin material is heated, either in the same recycled asphalt product heater or in a separate virgin material heater, to a maximum temperature not exceeding a prescribed temperature above which damage to that heater will occur. The heated recycled asphalt product is mixed with the heated virgin material in the selected proportion of recycled asphalt product to virgin material to prepare the asphalt mix product for delivery at the desired temperature. By virtue of heating the recycled asphalt product and mixing the heated recycled asphalt product with the heated virgin material, the selected proportion of recycled asphalt product to virgin material is not limited by the maximum temperature of the heated virgin material, and asphalt mix product is produced effectively and economically with proportions of recycled asphalt product to virgin material which are considerably higher than heretofore available.

7 Claims, 4 Drawing Sheets

METHOD AND APPARATUS FOR PRODUCING ASPHALT MIX PRODUCT COMPRISED OF RECYCLED ASPHALT PRODUCT AND VIRGIN MATERIAL

This application claims the benefit of provisional application Ser. No. 60/987,899, filed Nov. 14, 2007.

The present invention relates generally to the production of asphalt paving materials comprising a mixture of recycled asphalt product (RAP) and virgin material, and pertains, more specifically, to method and apparatus in which the proportion of recycled asphalt product to virgin material in the mixture is increased without concomitant adverse effects which otherwise could occur as a result of heating either the recycled asphalt product or the virgin material to an excessively high temperature.

In the asphalt industry there has been a steady rise in the cost of virgin ingredients necessary for producing the product, primarily due to the increasing cost of liquid asphalt cement (A.C.), which is the petroleum product used as the coating binder in new asphalt. Accordingly, greater attention now is being given to the use of recycled asphalt product (RAP) in producing new asphalt mix product, since RAP already contains the valued A.C., which is the costliest ingredient in the mix. Two basic methods currently are in use in introducing RAP into asphalt batch plants; namely, (a) the weigh hopper method, and (b) the separate RAP mixing drum method. In both of these methods, RAP is introduced cold, that is, at ambient temperature, and the methods require that the virgin material used in the mix be superheated in the dryer drum of the plant, prior to being mixed with the RAP, since the virgin material serves as the heat transfer medium that heats the ambient temperature RAP.

Both of the above methods have inherent limits in the amount of RAP that can be introduced effectively into the mix. The amount has been found to be considerably less than 50% of the total mix and generally is in the vicinity of about 25%. This is because the amount of heat transferred from the heated virgin material to the ambient temperature RAP is governed by physical properties of the virgin material, including temperature and moisture content. The virgin material can be heated only to a point where heating can be accomplished safely without damaging the asphalt plant dryer drum and other plant components. Even where there is no visible indication of damage, superheating the virgin material does indeed put great stress on plant components, resulting in increased wear and shortened service life. The aforesaid methods also are affected by the amount of moisture contained in the virgin material and in the RAP. Added moisture requires additional heat and reduces plant production capability.

With the weigh hopper method, the superheated virgin material is delivered to a weigh hopper in predetermined proportions, and then cold (ambient temperature) RAP is added. What occurs then is a violent reaction, generating unwanted volumes of steam and dust. The material is then dropped into the plant pug mill for blending and the addition of liquid asphalt cement.

With the separate RAP mixing drum method, superheated virgin material from the batch plant tower is transferred to a RAP mixing drum, with the cold RAP metered into the mixing drum. Again, since all heat is obtained from the superheated virgin material, the total amount of RAP that may be blended into the mix is considerably less than 50% of the total mix.

The present invention provides method and apparatus which enable asphalt mix product to be produced effectively and efficiently with readily selected greater proportions of recycled asphalt product to virgin material. Recycled asphalt product (RAP) is heated within an indirectly heated rotary drum RAP heater prior to being mixed with heated virgin material so that the virgin material is not relied upon as the sole source of heat for delivering the resulting asphalt mix product at a desired temperature. Indirectly heated rotary drum RAP heaters are fully described in U.S. Pat. Nos. 5,188,299, 5,294,062 and 5,520,342, each of which patents is incorporated herein by reference thereto. Thus, the present invention attains several objects and advantages, some of which are summarized as follows: Produces asphalt mix product for delivery at a desired temperature and having higher amounts of recycled asphalt product without exceeding temperatures at which damage or other deleterious effects will occur; enables the ready mixing of greater proportions of recycled asphalt product with virgin material to produce asphalt mix product without the necessity for superheating the virgin material; allows the creation of a wide range of specified blends of recycled asphalt product with virgin material without concomitant deleterious effects upon components of an asphalt mix plant, or to the constituents of the resulting asphalt mix product; provides increased flexibility in the selection of a desired proportion of recycled asphalt product to virgin material in creating an asphalt mix product; reduces batch plant stress and maintenance; enables the production of asphalt mix product with reduced amounts of virgin material and with a reduced requirement for added liquid asphalt cement, thereby reducing overall cost of manufacture; enables safe and reliable operation of an asphalt mix plant; extends the service life of components of an asphalt mix plant.

The above objects and advantages, as well as further objects and advantages, are attained by the present invention which may be described briefly as a method for producing asphalt mix product for delivery at a desired temperature, the asphalt mix product being comprised of a mixture of recycled asphalt product and virgin material and having a selected proportion of recycled asphalt product to virgin material, the method comprising: heating recycled asphalt product in an indirectly heated recycled asphalt product heater to an elevated temperature to prepare heated recycled asphalt product at the elevated temperature; heating virgin material in a virgin material heater to a maximum temperature not exceeding a prescribed temperature above which damage to the virgin material heater will occur, to prepare heated virgin material at the maximum temperature; and mixing the heated recycled asphalt product with the heated virgin material in the selected proportion of recycled asphalt product to virgin material to prepare the asphalt mix product for delivery at the desired temperature, whereby the selected proportion of recycled asphalt product to virgin material is not limited by the maximum temperature of the heated virgin material.

In addition, the present invention includes apparatus for producing asphalt mix product for delivery at a desired temperature, the asphalt mix product being comprised of a mixture of recycled asphalt product and virgin material and having a selected proportion of recycled asphalt product to virgin material, the apparatus comprising: an indirectly heated recycled asphalt product heater for heating recycled asphalt product to an elevated temperature to prepare heated recycled asphalt product at the elevated temperature; a virgin material heater for heating virgin material to a maximum temperature not exceeding a prescribed temperature above which damage to the virgin material heater will occur, to prepare heated virgin material at the maximum temperature; and a mixing arrangement for mixing the heated recycled asphalt product with the heated virgin material in the selected proportion of recycled asphalt product to virgin material to prepare the asphalt mix product for delivery at the desired temperature, whereby the selected proportion of recycled asphalt product to virgin material is not limited by the maximum temperature of the heated virgin material.

Further, the present invention provides a method for producing asphalt mix product for delivery at a desired temperature, the asphalt mix product being comprised of a mixture of recycled asphalt product and virgin material and having a selected proportion of recycled asphalt product to virgin material, the method comprising: heating recycled asphalt product in an indirectly heated recycled asphalt product heater to an elevated temperature to prepare heated recycled asphalt product at the elevated temperature, and heating virgin material in the recycled asphalt product heater to a maximum temperature not exceeding a prescribed temperature above which damage to the recycled asphalt product heater will occur, to prepare heated virgin material at the maximum temperature; and mixing the heated recycled asphalt product with the heated virgin material in the selected proportion of recycled asphalt product to virgin material to prepare the asphalt mix product for delivery at the desired temperature, whereby the selected proportion of recycled asphalt product to virgin material is not limited by the maximum temperature of the heated virgin material.

Still further, the present invention includes apparatus for producing asphalt mix product for delivery at a desired temperature, the asphalt mix product being comprised of a mixture of recycled asphalt product and virgin material and having a selected proportion of recycled asphalt product to virgin material, the apparatus comprising: an indirectly heated recycled asphalt product heater for alternately heating recycled asphalt product to an elevated temperature to prepare heated recycled asphalt product at the elevated temperature, and virgin material in the recycled asphalt product heater to a maximum temperature not exceeding a prescribed temperature above which damage to the recycled asphalt product heater will occur, to prepare heated virgin material at the maximum temperature; and a mixing arrangement for mixing the heated recycled asphalt product with the heated virgin material in the selected proportion of recycled asphalt product to virgin material to prepare the asphalt mix product for delivery at the desired temperature, whereby the selected proportion of recycled asphalt product to virgin material is not limited by the maximum temperature of the heated virgin material.

The invention will be understood more fully, while still further objects and advantages will become apparent, in the following detailed description of preferred embodiments of the invention illustrated in the accompanying drawing, in which.

Figure 1:
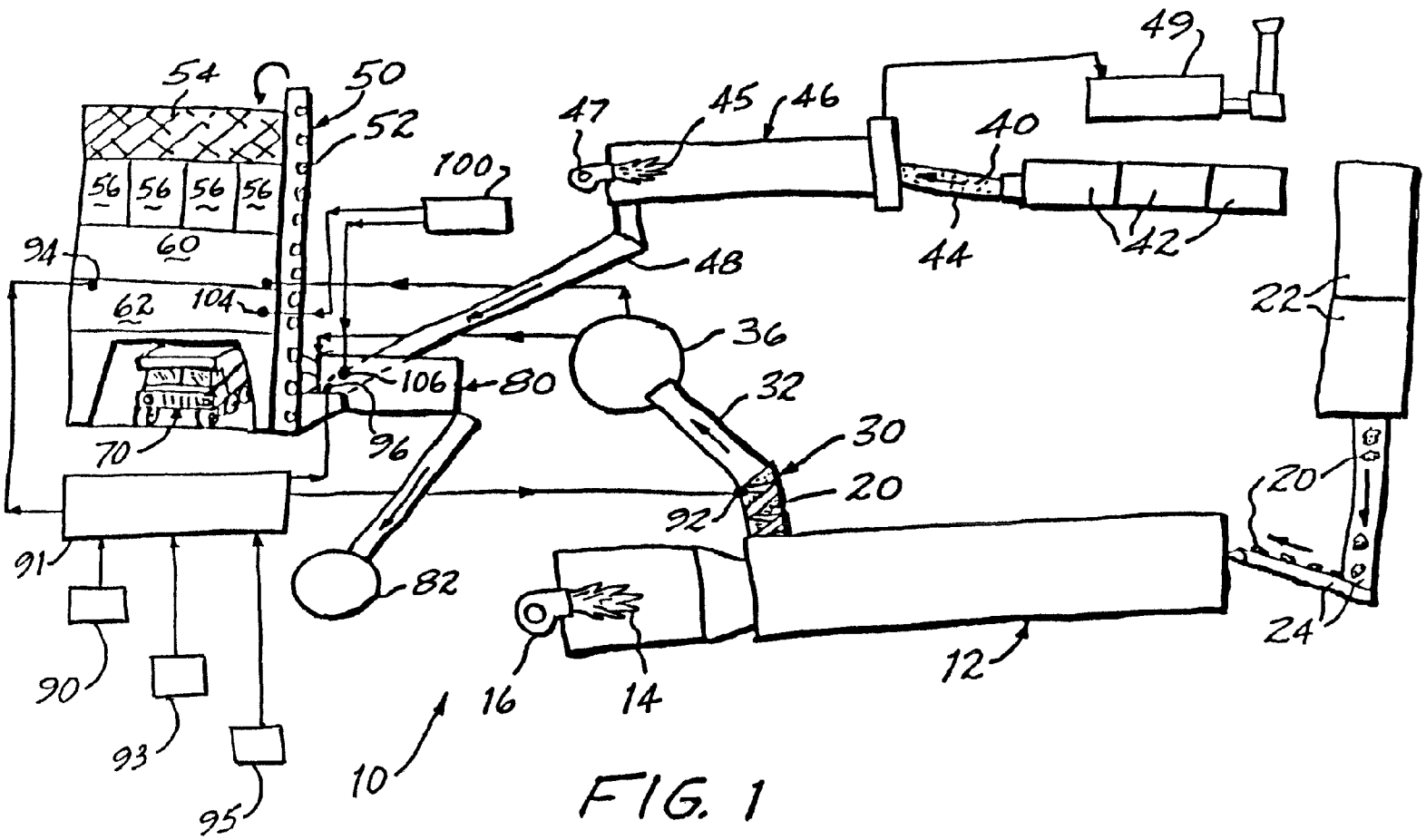
FIG. 1 is a diagrammatic depiction of an asphalt mix plant constructed and operated in accordance with the present invention.

Referring now to the drawing, and especially to FIG. 1 thereof, an asphalt mix plant is illustrated diagrammatically at 10 and is seen to include an indirectly heated rotary drum RAP heater 12 in which heat is supplied by a flame 14 established by a burner 16, all as disclosed more fully in the aforesaid U.S. Pat. Nos. 5,188,299, 5,294,062 and 5,520,342, the disclosures of each of which patents is incorporated herein by reference thereto. Cold recycled asphalt product (RAP), that is, RAP at ambient temperature, shown at 20, is delivered from cold RAP feed bins 22 to RAP heater 12 by feed belts 24. Fully heated RAP 20 is then discharged from RAP heater 12 and enters a post-mixer 30. A conveyor 32 then transfers the heated RAP 20 to a holding facility 36, which may be in the form of a surge hopper or a silo, for temporary holding of the heated RAP.

Virgin material, shown in the form of virgin aggregate 40, is delivered cold, that is, at ambient temperature, from cold virgin aggregate bins 42, as by a delivery conveyor 44, to a conventional virgin material dryer drum 46 where the virgin aggregate 40 is heated by heat supplied by a flame 45 established by a burner 47. Heated virgin aggregate 40 then is discharged to a discharge conveyor 48. Any dust generated during processing of the virgin aggregate 40 is collected and processed through a baghouse 49, as is conventional in processing virgin material.

Mixing of the heated RAP 20 and the heated virgin aggregate 40 is accomplished in alternate arrangements. Where a batch tower 50 is employed, discharge conveyor 48 delivers the heated virgin aggregate 40 to bucket conveyor 52 of the batch tower 50 and the bucket conveyor 52 transfers the fully heated virgin aggregate 40 to hot screens 54 where the heated virgin aggregate 40 is sorted and separated into hot bins 56, as is conventional in asphalt mix batch plants. Heated virgin aggregate 40 then is metered into weigh hopper 60 of batch tower 50 to establish a selected, specified amount of virgin aggregate 40. Heated RAP 20 is transferred from holding facility 36 to be metered intermittently into the weigh hopper 60 to establish a selected, specified amount of heated RAP 20. In this manner, a batch of heated RAP 20 and heated virgin aggregate 40 having an exact desired proportion of heated RAP 20 to heated virgin aggregate 40 is created, on demand. The batch then is transferred to pug mill 62 for blending to complete a fully mixed asphalt product which is then discharged and transmitted, for example, directly to a truck 70 for delivery.

In an alternate arrangement, the heated RAP 20 and the heated virgin aggregate 40 are delivered, in metered quantities, to a mixing drum 80 where the constituents are blended into an asphalt mix product. The asphalt mix product then is transferred from mixing drum 80 to a storage facility, shown in the form of a storage silo 82 for subsequent load-out into trucks for delivery.

A rejuvenator agent, which is a light mixture of asphalt and solvent used to replenish and rebalance properties lost as a result of oxidation of the asphalt in the RAP, may be introduced, from a source 90 of rejuvenator agent, through a distributor 91, into the heated RAP 20, as required, in any of three locations, as follows: A first location 92, where the rejuvenator agent is introduced into the heated RAP 20 within the post-mixer 30; a second location 94, where the rejuvenator agent is introduced into the pug mill 62; and a third location 96, where the rejuvenator agent is introduced into the mixing drum 80 for blending with the heated RAP. Alternately, a foaming agent may be introduced from a source 93 of foaming agent, through distributor 91, to any of the three locations 92, 94 or 96, or an emulsifying agent may be introduced from a source 95 of emulsifying agent, through distributor 91, to any of the three locations 92, 94 or 96. If required, liquid asphalt cement may be introduced, from a source 100 of liquid asphalt cement, into the heated virgin aggregate 40 at a location 104 at the pug mill 62, or at a location 106 at the mixing drum 80.

RAP 20 is heated in the RAP heater 12 to an elevated temperature. Preferably, the elevated temperature does not exceed a predetermined temperature above which damage to component parts of the heater 12 can occur. Excessively high temperatures within the heater 12 can result in early failure of the heater 12, increasing the frequency and cost of maintenance, as well as affecting production capability. In addition, excessively high temperatures can have an adverse affect on the quality of the heated RAP 20 itself. In the preferred procedure, the elevated temperature to which RAP 20 is heated within heater 12 is limited to a maximum of 325° F. The virgin aggregate 40 is heated in dryer drum heater 46 to a maximum temperature which does not exceed a prescribed temperature above which damage to component parts of the heater 46 can occur. Excessively high temperatures within the heater 46 can result in early failure of the heater 46, increasing the frequency and cost of maintenance, as well as affecting production capability. In the preferred procedure, the elevated temperature to which virgin aggregate 40 is heated within heater 46 is limited to a maximum of about 325° F.

With the RAP 20 heated fully to the elevated temperature and the virgin aggregate 40 heated fully to the maximum temperature, as described above, the resulting asphalt mix product is delivered at a desired temperature without the necessity for the maximum temperature of the heated virgin aggregate 40 to exceed the prescribed temperature. The disadvantages of having to heat virgin material to a superheated temperature are avoided. Moreover, with both constituents heated to the respective temperatures, any selected proportion of one constituent to the other is made available. As a result, asphalt mix product can be provided with RAP in any selected proportion from as little as one percent to as much as ninety-nine percent without any limitation imposed by the necessity to superheat the virgin aggregate. The preferred proportion of RAP to virgin aggregate is at least about fifty percent RAP. In the preferred procedure, with the RAP heated to a temperature within a range from about 220° F. and not exceeding 325° F. and the virgin aggregate heated to a temperature within a similar range of about 220° F. to 325° F., the blended asphalt product can be delivered at a desired temperature within the range of about 220° F. to 325° F., and in the above specified preferred proportions, without deleterious effects upon components of the asphalt mix product plant, or upon the constituents of the asphalt mix product itself.

Figure 2:
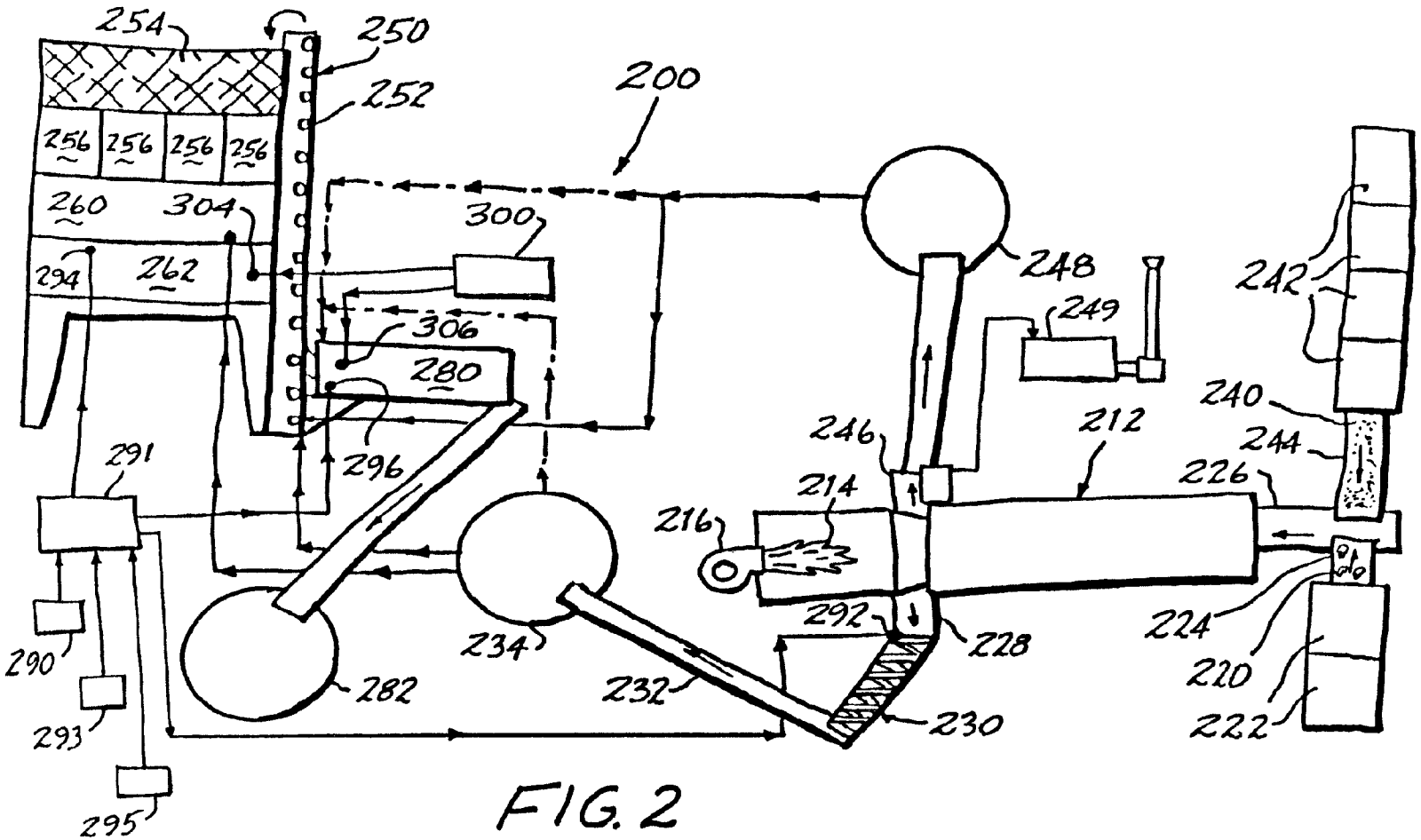
FIG. 2 is a diagrammatic depiction of an asphalt mix plant constructed and operated in accordance with another embodiment of the present invention.

Turning now to another embodiment of the present invention illustrated in FIG. 2, another asphalt mix plant is illustrated diagrammatically at 200 and is seen to include an indirectly heated rotary drum RAP heater 212 which serves to heat both RAP and virgin material for mixing to produce an asphalt mix product. As in the earlier-described embodiment, heat is supplied by a flame 214 established by a burner 216, and cold recycled asphalt product (RAP), at ambient temperature, shown at 220, is delivered from cold RAP feed bins 222 to RAP heater 212. However, delivery is accomplished by a delivery conveyor 224 which brings the cold RAP 220 to a feed belt 226 which then forwards the RAP 220 to RAP heater 212. Fully heated RAP 220 is discharged from RAP heater 212 to a discharge conveyor 228 and is transferred to enter a post-mixer 230. A further conveyor 232 then transfers the heated RAP 220 to a holding facility, shown in the form of a silo 234, for temporary holding of the heated RAP 212.

In the present embodiment, virgin material, shown in the form of virgin aggregate 240, is delivered cold, that is, at ambient temperature, from cold virgin aggregate bins 242, as by a delivery conveyor 244, also to feed belt 226 to be forwarded to RAP heater 212 where the virgin aggregate 240 is heated. Heated virgin aggregate 240 then is discharged to a discharge conveyor 246 and brought to a silo 248. The cold RAP 220 and the cold virgin aggregate 240 are heated by the RAP heater 212 in alternate sequential batches. Thus, delivery conveyors 224 and 244 are operated intermittently, in alternate cycles of operation, to transfer RAP 20 and virgin aggregate 240 to feed belt 226 in sequential batches which are then delivered to RAP heater 212 where the batches are heated and passed on to the appropriate corresponding discharge conveyor 228 or 246. Any dust generated during processing of the virgin aggregate 240 is collected and processed through an air filtration system, here shown in the form of a baghouse 249, as is conventional in processing virgin material.

In much the same operation as described above, in connection with asphalt mix plant 10, mixing of the heated RAP 220 and the heated virgin aggregate 240 is accomplished in alternate arrangements. Where a batch tower 250 is employed, heated virgin aggregate 240 is delivered to bucket conveyor 252 of the batch tower 250 and the bucket conveyor 252 transfers the fully heated virgin aggregate 240 to hot screens 254 where the heated virgin aggregate 240 is sorted and separated into hot bins 256, as is conventional in asphalt mix batch plants. Heated virgin aggregate 240 then is metered into weigh hopper 260 of batch tower 250 to establish a selected, specified amount of virgin aggregate 240. Heated RAP 220 is transferred from silo 234 to be metered intermittently into the weigh hopper 260 to establish a selected, specified amount of heated RAP 220. In this manner, a batch of heated RAP 220 and heated virgin aggregate 240 having an exact desired proportion of heated RAP 220 to heated virgin aggregate 240 is created, on demand. The batch then is transferred to pug mill 262 for blending to complete a fully mixed asphalt mix product which is then discharged for delivery.

In an alternate arrangement, the heated RAP 220 and the heated virgin aggregate 240 are delivered, in metered quantities, to a mixing drum 280 where the constituents are blended into an asphalt mix product. The asphalt mix product then is transferred from mixing drum 280 to a storage facility, shown in the form of a storage silo 282 for subsequent load-out into trucks for delivery.

A rejuvenator agent may be introduced, from a source 290 of rejuvenator agent, through a distributor 291, into the heated RAP 220, as required, in any of three locations, as follows: A first location 292, where the rejuvenator agent is introduced into the heated RAP 220 within the post-mixer 230; a second location 294, where the rejuvenator agent is introduced into the pug mill 262; and a third location 296, where the rejuvenator agent is introduced into the mixing drum 280 for blending with the heated RAP. Alternately, a foaming agent may be introduced from a source 293 of foaming agent, through distributor 291, to any of the three locations 292, 294 or 296, or an emulsifying agent may be introduced from a source 295 of emulsifying agent, through distributor 291, to any of the three locations 292, 294 or 296. If required, liquid asphalt cement may be introduced, from a source 300 of liquid asphalt cement, into the heated virgin aggregate 240 at a location 304 at the pug mill 262, or at a location 306 at the mixing drum 280.

Figure 3:
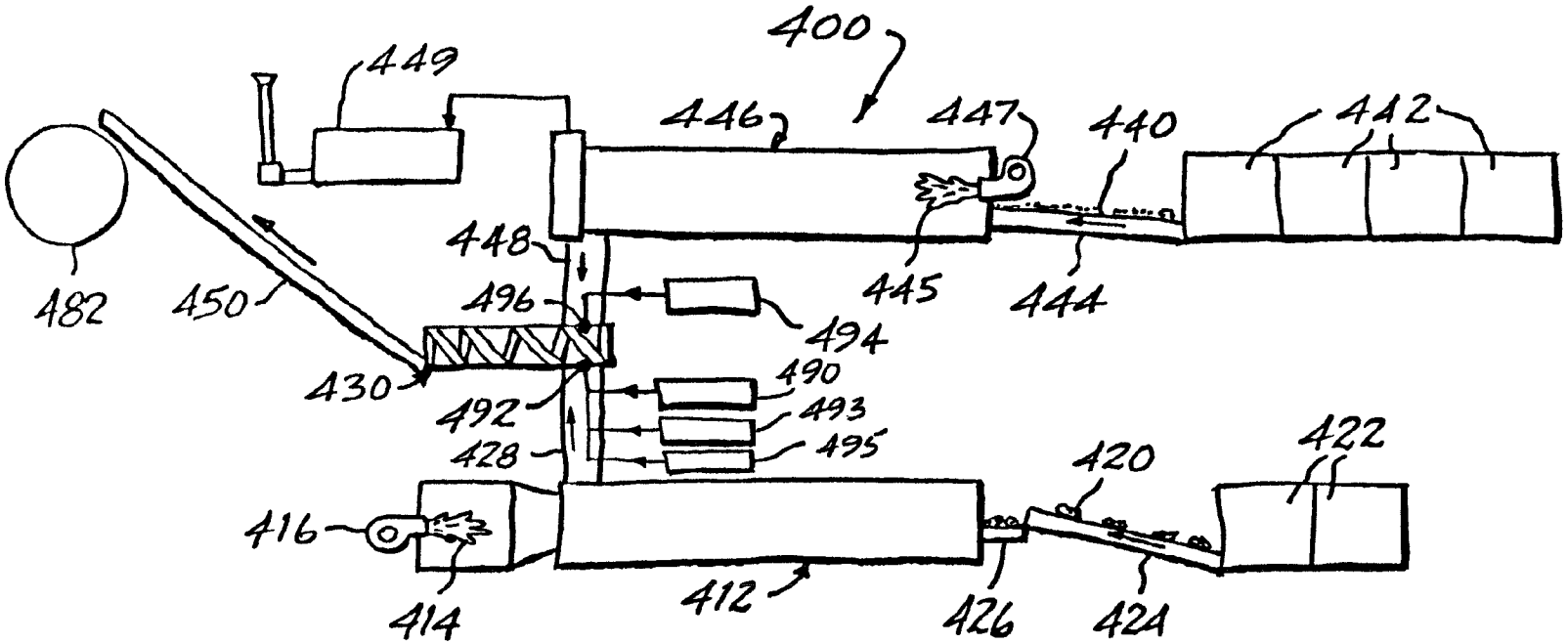
FIG. 3 is a diagrammatic depiction of an asphalt mix plant constructed and operated in accordance with still another embodiment of the present invention.

In still another embodiment of the present invention, illustrated in FIG. 3, an asphalt mix plant is illustrated diagrammatically at 400 and is seen to include an indirectly heated rotary drum RAP heater 412. As in the earlier embodiment described in connection with FIG. 1, heat is supplied by a flame 414 established by a burner 416, and cold recycled asphalt product (RAP), at ambient temperature, shown at 420, is delivered from cold RAP feed bins 422 to RAP heater 412. Delivery is accomplished by a delivery conveyor 424 which brings the cold RAP 420 to a feed belt 426 which then forwards the RAP 420 to RAP heater 412. Fully heated RAP 420 is discharged from RAP heater 412 to a discharge conveyor 428 and is transferred to enter a post-mixer 430.

Virgin material, shown in the form of virgin aggregate 440, is delivered cold, that is, at ambient temperature, from cold virgin aggregate bins 442, as by a delivery conveyor 444, to a dryer drum 446 where the virgin aggregate 440 is heated by heat supplied by a flame 445 established by a burner 447. Dryer drum 446 may be in the form of a parallel flow dryer drum, as shown, or a counter flow dryer drum (not shown). Heated virgin aggregate 440 then is discharged to a discharge conveyor 448 for transfer to the post-mixer 430. Any dust generated during processing of the virgin aggregate 440 is collected and processed through a baghouse 449, as is conventional in processing virgin material.

The heated RAP 420 and the heated virgin aggregate 440, once delivered to the post-mixer 430, are then mixed in the post-mixer 430 to blend the constituents into an asphalt mix product. The asphalt mix product then is transferred by a supply conveyor 450 from the post-mixer 430 to a storage facility, shown in the form of a storage silo 482 for subsequent load-out into trucks for delivery.

Rejuvenator agent from a source 490 is introduced into heated RAP 420 at a location 492 at the post-mixer 430. Alternately, a foaming from a source 493 of foaming agent, or an emulsifying agent from a source 495 of emulsifying agent, may be introduced at location 492. If necessary, liquid asphalt cement from a source 494 of liquid asphalt cement is introduced into heated virgin aggregate 440 at a location 496 at the post-mixer 430.

Figure 4:
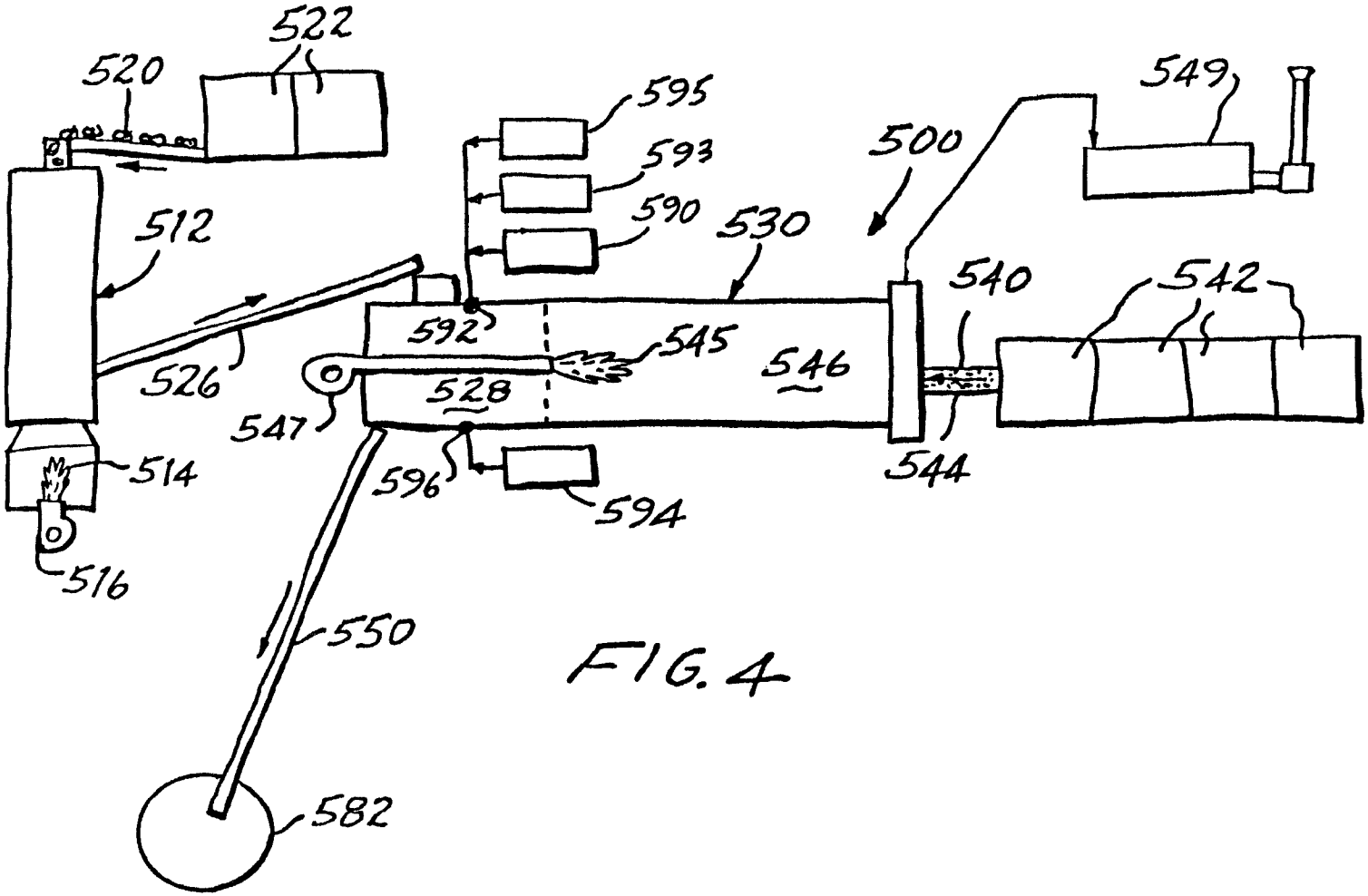
FIG. 4 is a diagrammatic depiction of an asphalt mix plant constructed and operated in accordance with yet another embodiment of the present invention.

In yet another embodiment of the present invention, illustrated in FIG. 4, an asphalt mix plant is illustrated diagrammatically at 500 and is seen to include an indirectly heated rotary drum RAP heater 512. As in the earlier embodiment described in connection with FIG. 1, heat is supplied by a flame 514 established by a burner 516, and cold recycled asphalt product (RAP), at ambient temperature, shown at 520, is delivered from cold RAP feed bins 522 to RAP heater 512. Delivery is accomplished by a delivery conveyor 524 which brings the cold RAP 520 to the RAP heater 512. Fully heated RAP 520 is discharged from RAP heater 512 to a discharge conveyor 526 and is transferred to enter mixing section 528 of a counter flow drum mixer 530.

Virgin material, shown in the form of virgin aggregate 540, is delivered cold, that is, at ambient temperature, from cold virgin aggregate bins 542, as by a delivery conveyor 544, to heating section 546 of the counter flow drum mixer 530 where the virgin aggregate 540 is heated by heat supplied by a flame 545 established by a burner 547. Heated virgin aggregate 540 then is moved to the mixing section 528 of the counter flow drum mixer 530 to be mixed and blended with the heated RAP 520. Any dust generated during processing of the virgin aggregate 540 is collected and processed through a baghouse 549, as is conventional in processing virgin material.

The heated RAP 520 and the heated virgin aggregate 540, once delivered to the mixing section 538 of the counter flow drum mixer 530, are then mixed in the mixing section 528 to blend the constituents into an asphalt mix product. The asphalt mix product then is transferred by a supply conveyor 550 from the counter flow drum mixer 530 to a storage facility, shown in the form of a storage silo 582 for subsequent load-out into trucks for delivery.

Rejuvenator agent from a source 590, or a foaming agent from a source 593, or an emulsifying agent from a source 595, is introduced into heated RAP 520 at a location 592 at the mixing section 528 of the counter flow drum mixer 530, and liquid asphalt cement from a source 594 is introduced, if necessary, into heated virgin aggregate 540 at a location 596 at the mixing section 528 of the counter flow drum mixer 530.

It will be seen that the present invention attains all of the objects and advantages summarized above, namely: Produces asphalt mix product for delivery at a desired temperature and having higher amounts of recycled asphalt product without exceeding temperatures at which damage or other deleterious effects will occur; enables the ready mixing of greater proportions of recycled asphalt product with virgin material to produce asphalt mix product without the necessity for superheating the virgin material; allows the creation of a wide range of specified blends of recycled asphalt product with virgin material without concomitant deleterious effects upon components of an asphalt mix plant, or to the constituents of the resulting asphalt mix product; provides increased flexibility in the selection of a desired proportion of recycled asphalt product to virgin material in creating an asphalt mix product; reduces batch plant stress and maintenance; enables the production of asphalt mix product with reduced amounts of virgin material and with a reduced requirement for added liquid asphalt cement, thereby reducing overall cost of manufacture; enables safe and reliable operation of an asphalt mix plant; extends the service life of components of an asphalt mix plant.

It is to be understood that the above detailed description of preferred embodiments of the invention are provided by way of example only. Various details of design, construction and procedure may be modified without departing from the true spirit and scope of the invention, as set forth in the appended claims.

The embodiments of the invention in which an exclusive property or privilege is claimed are defined as follows:

1. A method for producing asphalt mix product for delivery at a desired temperature, the asphalt mix product being comprised of a mixture of recycled asphalt product and virgin material and having a selected proportion of recycled asphalt product to virgin material, the method comprising:

heating recycled asphalt product indirectly in an indirectly heated recycled asphalt product heater to an elevated temperature to prepare heated recycled asphalt product at the elevated temperature, and heating virgin material in the indirectly heated recycled asphalt product heater exclusively indirectly to a maximum temperature not exceeding a prescribed temperature above which damage to the recycled asphalt product heater will occur, to prepare heated virgin material at the maximum temperature; and mixing the heated recycled asphalt product with the heated virgin material in the selected proportion of recycled asphalt product to virgin material to prepare the asphalt mix product for delivery at the desired temperature, whereby the selected proportion of recycled asphalt product to virgin material is not limited by the maximum temperature of the heated virgin material.

2. The method of claim 1 wherein the recycled asphalt product and the virgin material are heated in the indirectly heated recycled asphalt product heater in alternate sequential batches.

3. The method of claim 2 wherein the desired temperature of the asphalt mix product is between about 220° F. and 325° F., the elevated temperature of the recycled asphalt product does not exceed 325° F., and the maximum temperature of the virgin material does not exceed about 325° F.

4. The method of claim 1 wherein the selected proportion of recycled asphalt product to virgin material is at least approximately fifty percent recycled asphalt product.

5. Apparatus for producing asphalt mix product for delivery at a desired temperature, the asphalt mix product being comprised of a mixture of recycled asphalt product and virgin material and having a selected proportion of recycled asphalt product to virgin material, the apparatus comprising:

an indirectly heated recycled asphalt product heater for indirectly heating recycled asphalt product to an elevated temperature to prepare heated recycled asphalt product at the elevated temperature, and for heating virgin material in the indirectly heated recycled asphalt product heater exclusively indirectly to a maximum temperature not exceeding a prescribed temperature above which damage to the recycled asphalt product heater will occur, to prepare heated virgin material at the maximum temperature; and a mixing arrangement for mixing the heated recycled asphalt product with the heated virgin material in the selected proportion of recycled asphalt product to virgin material to prepare the asphalt mix product for delivery at the desired temperature, whereby the selected proportion of recycled asphalt product to virgin material is not limited by the maximum temperature of the heated virgin material.

6. The apparatus of claim 5 wherein the mixing arrangement includes an asphalt mix plant having a pug mill to which the heated recycled asphalt product and the heated virgin material are transferred for mixing.

7. The apparatus of claim 5 wherein the mixing arrangement includes a mixing drum to which the heated recycled asphalt product and the heated virgin material are transferred for mixing.

* * * * *